United States Patent [19]

Johns

[11] Patent Number: 4,911,435

[45] Date of Patent: Mar. 27, 1990

[54] EXERCISE MACHINERY CONVERTIBLE FOR USE BY WHEELCHAIR-SEATED EXERCISERS

[75] Inventor: George A. Johns, Richardson, Tex.

[73] Assignee: Nautilus Sports Medical Industries, Inc., Park Central, Tex.

[21] Appl. No.: 197,086

[22] Filed: May 20, 1988

[51] Int. Cl.[4] ..... A63R 21/00

[52] U.S. Cl. ..... 272/134; 272/DIG. 4; 272/143; 280/304.1

[58] Field of Search ..... 272/134, DIG. 4, 144, 272/116, 117, 118, 73; 128/25 R; 280/304.1; 297/14, 331

[56] References Cited

U.S. PATENT DOCUMENTS

| | | | |
|---|---|---|---|
| 1,369,633 | 2/1921 | Dietrich et al. | 297/14 |
| 3,850,431 | 11/1974 | Winan | 272/118 |
| 4,087,127 | 5/1978 | Lotta | 297/14 |
| 4,222,376 | 9/1980 | Praprotnik | 128/25 R |
| 4,354,676 | 10/1982 | Ariel | 272/129 |
| 4,402,502 | 9/1983 | Peters | 128/25 R X |
| 4,601,464 | 7/1986 | Mousel | 272/DIG. 4 X |
| 4,709,920 | 12/1987 | Schnell | 272/117 |
| 4,746,115 | 5/1988 | Lahman | 272/130 |
| 4,765,614 | 8/1988 | Shute | 272/134 X |
| 4,834,396 | 5/1989 | Schnell | 272/134 X |
| 4,846,156 | 7/1989 | Kopnicky | 272/134 X |

OTHER PUBLICATIONS

Soloflex Catalog; 272/93; 1981; 7 pages.

*Primary Examiner*—Richard J. Apley
*Assistant Examiner*—Howard Flaxman
*Attorney, Agent, or Firm*—Hubbard, Thurman, Turner, Tucker & Harris

[57] ABSTRACT

A variety of selectively variable resistance exercise machines, of the type in which the exerciser is seated while grasping and forcibly moving a hand operable force input portion of the machine, are modified to permit their use by both able bodied and physically challenged, wheelchair-seated exercisers. To permit this alternate usage of the machines, each is provided with a movable, height adjustable seat structure which may be selectively pivoted between an able bodied exerciser use position, and a physically challenged exerciser use position. With the movable seat structure in this latter position, a wheelchair-confined exerciser may move the chair into the space previously occupied by the seat structure to thereby permit the exerciser to conveniently reach and operatively manipulate the machine's force input portion. Differently sized floor ramp sets are provided to effect wheelchair height adjustment, and stabilizing straps are provided to releasably secure the exerciser and his wheelchair in an operative position relative to the machine. One of the machines has a unique "reverse pullover" input motion designed to simulate wheelchair ambulation motion to thereby strengthen the exerciser's muscles used in forcibly rotating the wheels of the chair. Additionally, each of the machines may be provided with a specially designed double pin progressive resistance weight stack having differently sized weight elements and a central weight element connection rod which may be lifted and lowered by the physically challenged exerciser without moving any of the individual weight elements.

21 Claims, 7 Drawing Sheets

EXERCISE MACHINERY CONVERTIBLE FOR USE BY WHEELCHAIR-SEATED EXERCISERS

BACKGROUND OF THE INVENTION

The present invention relates generally to exercise apparatus and, in a preferred embodiment thereof, more particularly provides selectively variable resistance exercise machinery which is uniquely convertible for use by either able bodied or physically challenged, wheelchair-seated exercisers and is provided with various other structural and operational improvements.

An alternative to traditional "free weight" devices, such as barbells, dumb bells and the like, various types of selectively variable resistance exercise machines are now commonly used to exercise, strengthen and develop selected upper body muscle groups of the exerciser. Machines of this type typically comprise a floor mounted, vertically extending frame structure to which a hand operable force input lever structure, bar or the like is movably secured to generate a pivotal output force when forcibly moved by the exerciser in the prescribed manner. The pivotal output force is yieldingly resisted with a selectively variable force by means of a multi-element, vertically movable weight stack interconnected to the force input portion by a chain, sprocket and cam system. Alternatively, various types of elastic cord resistance systems may be utilized.

To properly position the exerciser relative to the machine's force input portion, a height adjustable, but otherwise nonmovable seat structure is positioned operatively adjacent such input portion to permit the seated exerciser to conveniently grasp and forcibly move the same.

While machines of this general type are quite convenient for and popular with able bodied exercisers with sufficient dexterity to manipulate themselves onto and off of the machine's fixed seat structure, they present considerable use barriers to physically challenged exercisers confined to wheelchairs. Simply stated, the fixed position seat structure conventionally associated with such machines precludes the positioning of the wheelchair close enough to the force input portion of the machine to enable the wheelchair-seated exerciser to operatively manipulate it. In the past, it has accordingly been necessary to use one or more assistants to lift the physically challenged exerciser onto and off of the machine's seat structure from and into his wheelchair, respectively. This cumbersome procedure, as can be imagined, renders the use of this type of machinery highly inconvenient, and in many instances impractical, to the wheelchair confined exerciser.

It is accordingly an object of the present invention to provide improvements to exercise machinery of the general type described which will enable it to be conveniently used by both able bodied and wheelchair-seated exercisers.

SUMMARY OF THE INVENTION

In carrying out principles of the present invention, in accordance with preferred embodiments thereof, several representative selectively variable resistance type exercise machines are provided, each of which is rapidly and easily convertible between first and second orientations that respectively enable the machine to be conveniently operated by an able bodied exerciser or a physically challenged, wheelchair - seated exerciser.

Each machine basically comprises a floor supported, vertically extending support frame structure having a forwardly opening exerciser entry area. Pivotally secured to the frame structure, and positioned operatively adjacent such entry area, is a hand operable force input portion of the machine which is provided with a pair of handle portions that may be grasped by the exerciser and pushed or pulled to pivot the input portion. Pivotal motion of the input portion is resisted with a yielding, selectively variable force by a vertically movable, multi-element weight stack carried by the frame structure and operatively connected to the force input portion by a conventional chain, sprocket and cam system or the like.

The rapid conversion of each machine between its able bodied exerciser use orientation and its wheelchair seated exerciser use orientation is provided by means of a unique height adjustable seat mechanism that is carried by the frame structure for movement relative thereto between an able bodied user position and a wheelchair-seated user position. Suitable latch means are provided for releasably locking the movable seat mechanism in a selected one of its two positions.

With the seat mechanism in its able bodied user position, a padded seat portion thereof is operatively positioned generally within the exerciser entry area in a manner such that the able bodied exerciser may walk into the entry area, adjust the height of and sit upon the seat to permit him to conveniently grasp and appropriately manipulate the force input handles of the machine.

From its able bodied user position the seat mechanism is rapidly pivotable to its wheelchair-seated user position in which it is disposed generally outwardly of the entry area to permit the physically challenged exerciser to roll his wheelchair into the entry area and position its seat generally in the location vacated by the movable seat mechanism. The physically challenged exerciser may thus use the machine while seated in his wheelchair. Suitable strap means may be provided for holding the wheelchair and its occupant in an operative position relative to the particular exercise machine. Additionally, height adjustment of the wheelchair is achieved by providing differently configured ramp pairs which may be positioned on the floor within the machine entry area for supporting the wheelchair at a selectively variable elevation.

In one embodiment of the exercise machine of the present invention a unique exercise input movement is provided which is designed to simulate the wheel-pushing hand and arm movements involved in forward wheelchair ambulation. In such embodiment, the legs of a generally U-shaped force input member are pivoted adjacent their outer ends to an elevated portion of the frame structure for pivotal motion about a horizontal axis positioned forwardly of the seated exerciser and vertically adjacent his upper chest and shoulder area, the closed end of the force input member being positioned forwardly of the seated exerciser.

A pair of elongated force input levers are anchored at inner ends thereof to the legs of the U-shaped force input member slightly inwardly of their frame structure pivot points. From their connection to the force input member the levers extend past opposite sides of the seated exerciser, the levers being provided with handgrip portions at their outer ends. To use the machine, the exerciser grasps the handles and pushes them downwardly and forwardly to thereby pivot the force input member upwardly against the selectively variable force of the vertically movable weight stack.

This force-resisted exercise motion closely simulates the motion used by a wheelchair occupant to forwardly rotate the wheels of his chair, and accordingly strengthens the muscle groups used in such forward wheelchair ambulation. While this exercise motion is particularly beneficial to wheelchair users, it may also be effectively utilized by able bodied exercisers to strengthen their arm, shoulder and upper back muscles in a unique fashion.

According to another aspect of the present invention, a specially designed progressive size weight stack is provided which further facilitates physically challenged exerciser use of any of the representative machines. The weight stack is formed from relatively large weights at the bottom of the stack, intermediate size weights along a vertically intermediate portion of the stack, and relatively small weights at the top of the stack. An elongated vertical connection rod is slidably disposed within aligned vertical openings in the individual weights and has a vertically spaced series of horizontal pin openings therein which are alignable with corresponding horizontal openings formed through the individual weights. The connection rod is operatively secured at its upper end to an outer chain end of resistance portion of the machine to be selectively raised and lowered thereby during machine use.

Two connector pins are provided to secure to the connecting rod a selectively variable number of individual weights in the stack. With both pins removed, the connecting rod may be raised and lowered by the exerciser without carrying any of the individual weight elements with it, thereby providing a very light input motion resistance for exercisers with only very limited hand and/or arm strength.

By inserting one of the pins through the horizontal opening in the uppermost weight element into the top hole in the connecting rod, the relatively small weight of such uppermost element may be added to that of the connecting rod. With the top pin inserted in this manner, lowering of the top weight onto the balance of the stack automatically brings the rest of the holes in the connection rod into alignment with the corresponding horizontal holes in the remaining weight elements so that still further weight elements can be selectively secured to the connection rod using the second pin.

While the representative exercise machines of the present invention, due to their novel movable seat structures, are conveniently usable by wheelchair seated exercisers in the manner previously described, various of the machines may also be configured to permit the wheelchair exerciser to transfer himself from the wheelchair to the seat structure in its able bodied use position. To facilitate this transfer, a pair of armrest members are pivotally secured to the machine's frame structure for movement between generally vertical positions and generally horizontal positions in which the armrests extend along opposite sides of the movable seat structure in its able bodied user position. By moving his wheelchair alongside the seat structure, and lowering the inner side of the wheelchair, the exerciser may lower the far side armrest and pull on it to slide himself off the wheelchair seat and onto the movable seat structure. When the exercise routine is completed, the exerciser may simply reach over and grasp and pull the far side of the wheelchair to slide himself off of the machine seat and back onto the wheelchair seat.

DETAILED DESCRIPTION

Figure 1:
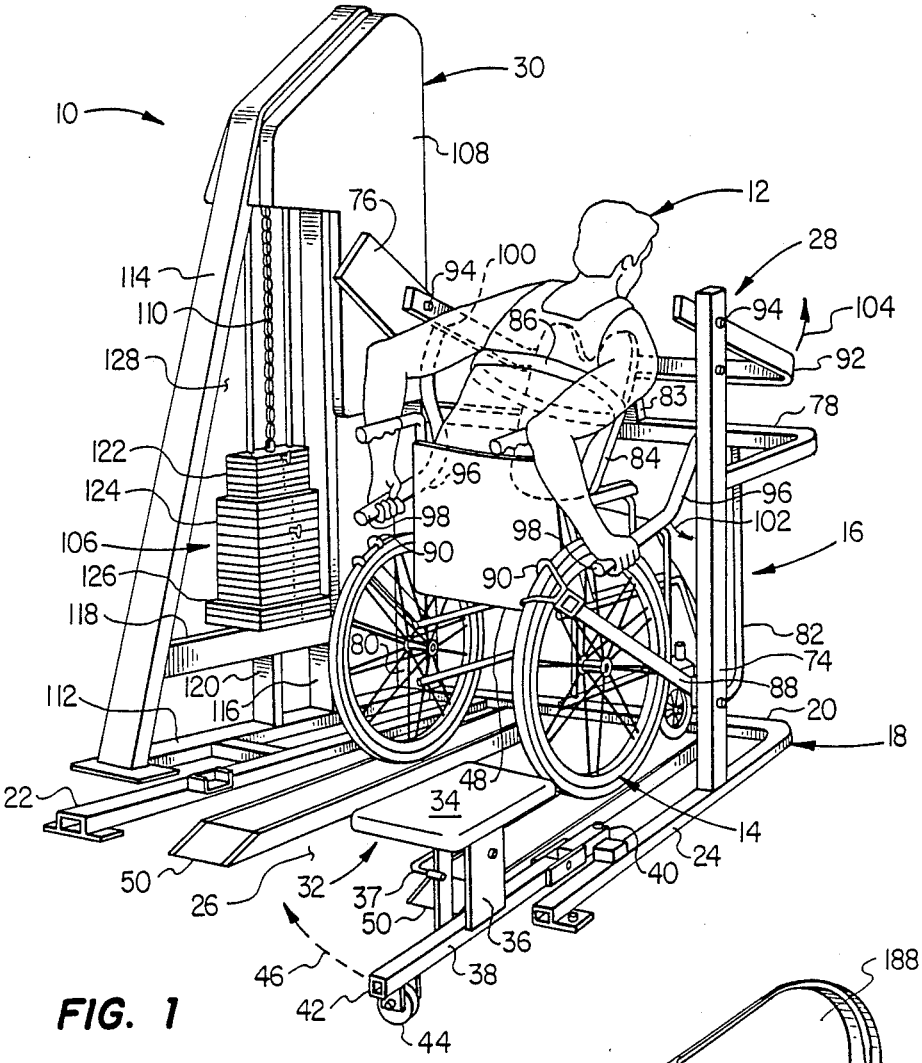
FIG. 1 is a perspective view of a selectively variable resistance exercise machine which embodies principles of the present invention and is uniquely adapted for use by both able bodied and physically challenged, wheelchair-seated exercisers.

Perspectively illustrated in FIG. 1 is a selectively variable resistance exercise machine 10 which embodies principles of the present invention and is uniquely convertible between first and second orientations which respectively permit the convenient use of the machine by an able bodied exerciser (not shown) and a physically challenged exerciser 12 seated in a wheelchair 14. Subsequently described representative alternate embodiments of the machine 10 are depicted in FIGS. 2–6 and, among other differences from the machine 10, provide for different exercise input movements.

The machine 10 depicted in FIG. 1 comprises a floor mounted, vertical support frame structure 16 including a generally U-shaped base 18 having a closed end portion 20 from which horizontally spaced left and right leg portions 22, 24 forwardly extend. A portion of the open end of the base 18 generally defines an entry area 26 through which, in a manner subsequently described, an able bodied or wheelchair-seated exerciser may enter to operatively position himself with respect to a force input portion 28 of the machine 10. The machine 10 also includes an input force resistance portion 30 which is supported on the floor to the left of the base leg 22.

To facilitate its rapid conversion between able bodied exerciser use and wheelchair-seated exerciser use, the machine 10 is uniquely provided with a height adjustable seat structure 32 which includes a padded seat portion 34. Seat portion 34 is positioned atop a conventional height adjustment structure 36 having a seat-height adjustment lever 37 and secured at its lower end to an elongated horizontal support channel member 38. The inner end 40 of the support member 38 is pivotally connected to an inner side of the base leg 24, and the outer end 42 of the support member 38 is provided with a suitable caster wheel 34 which rollingly supports such outer end on the floor.

The seat structure 32 is horizontally pivotable relative to the base 18 (by rolling the seat structure along the floor) between a physically challenged exerciser use position depicted in FIG. 1, and an able bodied exerciser use position (not illustrated in FIG. 1) in which the support member 38 is pivoted in the direction of arrow 46 to a position in which the support member 38 extends transversely across the entry area 26 between the base legs 22 and 24. The support member 38 may be suitably latched in this transverse position by, for example, pin means insertable through the outer support member end 42 into the base leg 22.

With the seat structure 32 in its able bodied user position, the seat portion 34 is disposed within the entry area 26 at an operative location relative to the force input portion 28 such that an able bodied exerciser may walk into the entry area 26, adjust the height of the seat portion 34, sit on the seat portion and conveniently grasp and manipulate the force input portion 28 in a manner subsequently described. The fixed position seat structures of conventional exercise machines of this general type block the movement of wheelchairs through the machine entry area to this operative seat location, thereby effectively precluding the use of the machine by a wheel chair - seated exerciser.

However, the present invention uniquely solves this problem by its provision of the pivotally mounted swing-away seat structure 32 just described. Specifically, with the seat structure 32 swung out to its physically challenged exerciser use position depicted in FIG. 1, the seat structure no longer impedes wheel chair movement into the entry area 26. Instead, the seat portion 34 is positioned forwardly of and generally to one side of the entry area 26, thereby permitting the physically challenged exerciser 12 to roll his wheelchair 14 into the entry area 26 to position the wheelchair seat 48 generally in the operative location vacated by the swung-out machine seat portion 34. The wheel-chair seat 48 thus functions to position the exerciser 12 in the aforementioned operative location relative to the force input portion 28 of the machine 10 in which the exerciser 12 may conveniently grasp and manipulate the force input portion in a manner subsequently described.

Selective height adjustment of the wheel-chair seat 48 is provided by means of differently sized ramp pairs (only one pair 50 of which is illustrated in FIG. 1) which may be placed in the entry area 26 as shown to support the wheel chair at a predetermined height relative to the force input portion 28 of the machine 10.

Figure 7:
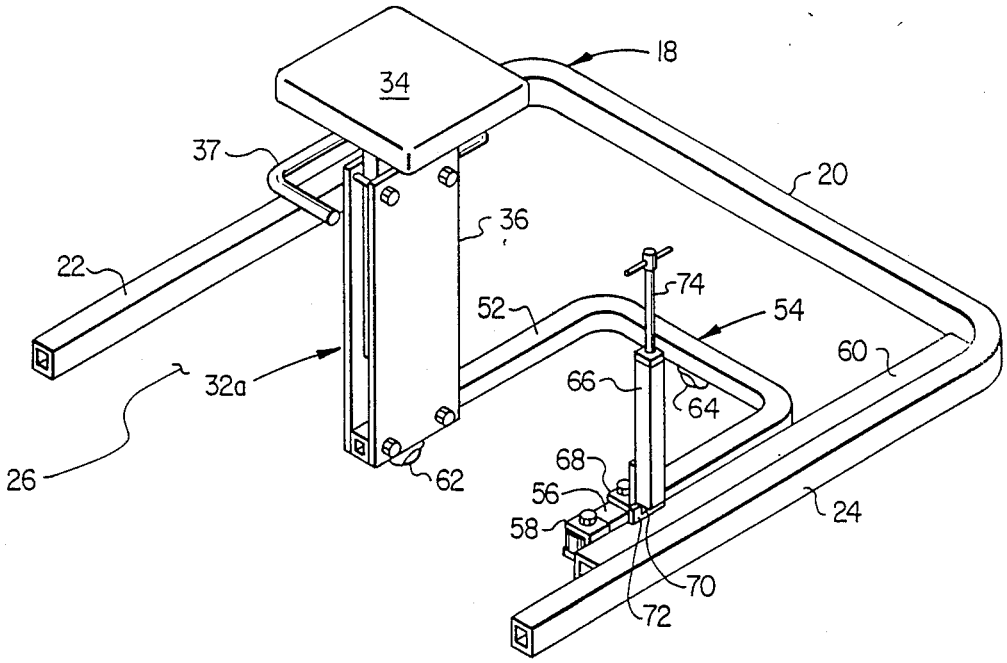
FIGS. 7–9 perspectively illustrate the structure and operation of a specially designed swing-away seat mechanism which may be utilized n conjunction with the exercise machines depicted in FIGS. 1–3.
Figure 8:
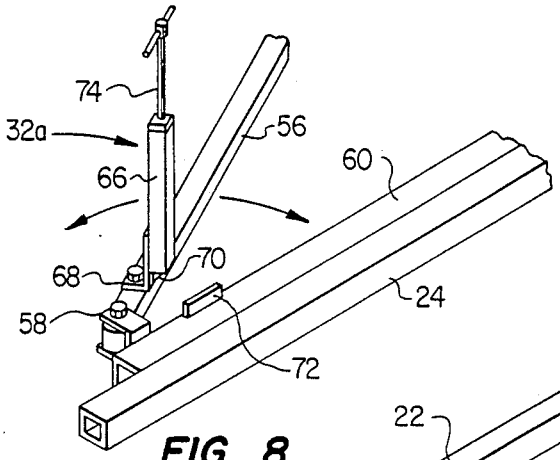
Figure 9:
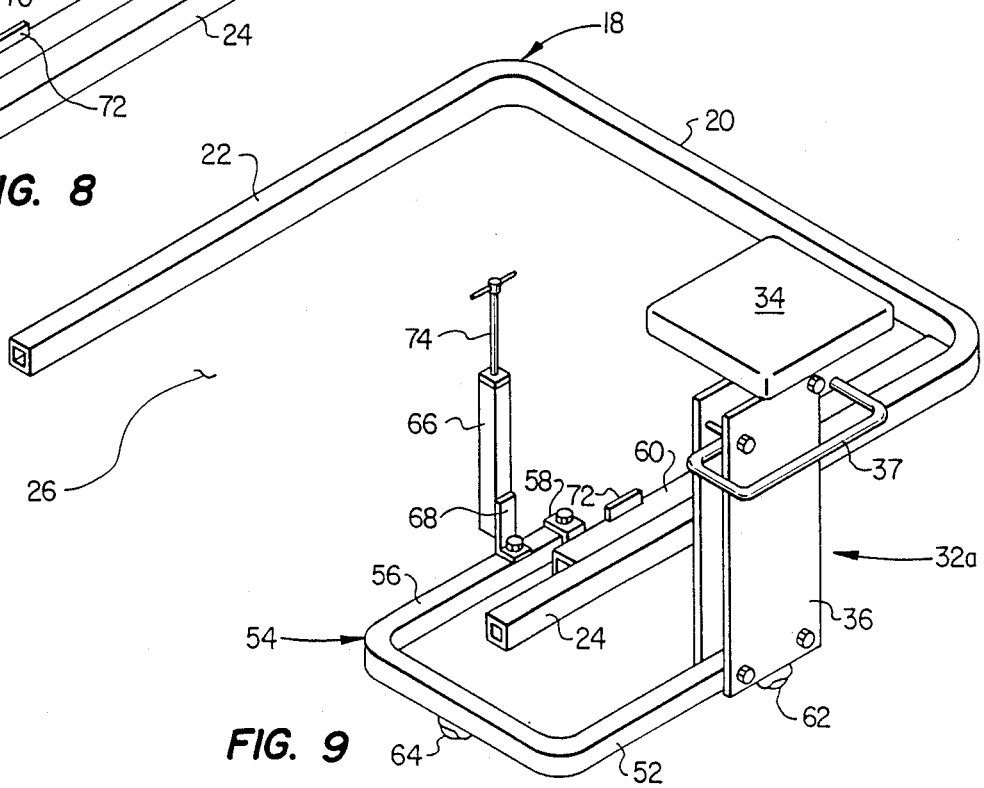

Illustrated in FIGS. 7–9 is an alternate embodiment $32_a$ of the previously described movable seat structure 32 which may be utilized in place thereof in the machine 10. In the modified movable seat structure $32_a$, the height adjustment structure 36 is secured at its lower end to the outer end of the left leg portion 52 of a generally U-shaped support member 54 having a right leg portion 56 whose outer end is pivotally carried within a yoke member 58 anchored to the outer end of an elongated auxiliary attachment channel member 60 secured to the inner side of the base leg 24. Suitable floor roller members 62 and 64 are operatively secured to the underside of the support member 54 as illustrated to permit it to be rolled along the floor.

As can be best seen in FIG. 7, the U-shaped support member 54 is shorter and narrower than the base 18. With the seat structure $32_a$ in its able bodied user position shown in FIG. 7, the support member 54 is positioned entirely within the entry area 26 with the leg portion 56 extending rearwardly along the inner side surface of the auxiliary attachment member 60. The padded seat portion 34 is positioned generally centrally within the entry area 26 in the previously described operative location relative to the force input portion of the machine. The support member 54 is releasably latched in this position by means of a latching mechanism which includes a vertical latch housing 66 secured at its lower end to the right leg portion 56 of the support member 54 by means of a bracket 68.

Projecting downwardly through the lower end of the latch housing 66 is a spring loaded, generally wedge-shaped latch member 70 (see FIG. 8) which is snapped over a vertically projecting latching tab 72 to prevent counterclockwise pivotal motion of the support member 54 away from its position depicted in FIG. 7. A T-shaped release member 74 projects upwardly through the upper end of the latch housing 66 and is operatively connected to the latch member 70 in a manner such that when the handle is pulled upwardly the latch member is also moved upwardly to release it from the latch tab 72 to permit counterclockwise pivoting of the support member 54.

With the latch member 70 released in this manner, the support member 54 may be pivoted in a counterclockwise direction, through a 180° arc, to bring the seat structure $32_a$ to its physically challenged exerciser use position depicted in FIG. 9. With the seat structure $32_a$ in this alternate orientation, the support member leg portion 56 extends forwardly along the base leg 24, and the seat portion 34 and its associated height adjustment structure 36 are positioned rightwardly of the entry area 26 to thereby permit unimpeded wheelchair entry thereinto as previously described. When the seat structure $32_a$ is pivoted back to its able bodied exerciser use position depicted in FIG. 7, the latch member 70 automatically snaps back over the latch tab 72 to again releasably lock the seat structure in its able bodied user position.

Returning again to FIG. 1, the exercise machine 10 provides a unique exercise input motion which closely simulates the hand and arm movement used by a wheelchair occupant to forwardly rotate the wheels of his chair, to effect forward wheelchair ambulation, in a manner which will now be described. The frame structure 16 includes a vertical post member 74 secured at its lower end to the base leg 24, and a rectangular connection member 76 secured to an upper section of the resistance portion 30. A U-shaped support member 78 is positioned forwardly of the post member 74 and is secured at its inner ends to a vertically intermediate portion of the support post 74 and a vertically extending rear section 80 of the resistance portion 30. The member 78 is braced to the closed end 20 of the base 18 by a generally L-shaped bracing member 82. Projecting upwardly from a central portion of the support member 78 is a post member 83 to which a forwardly and upwardly sloped padded chest engagement member 84 is secured. During use of the machine 10, the physically challenged exerciser 12 leans forwardly to bring his chest into engagement with the member 84 and is removably secured thereto by means of an upper body restraining strap 86 secured to the chest member 84. Rearward movement of the wheelchair 14 along the ramps 50 is precluded by means of a pair of restraining straps 88 which are secured at inner ends thereof to the support frame structure, and at their outer ends to the wheels of the chair by hook portions 90.

The force input portion 28 of the machine 10 includes a U-shaped force input receiving member 92 which is positioned forwardly of the post 74 and above the support member 78, and is pivotally connected at its inner ends, at pivot points 94, to the post 74 and the connection member 76. The force input portion also includes a pair of elongated force input lever members 96 which are provided at their outer ends with handle portions 98 and are anchored at their inner ends to the legs of the force input receiving member 92 at points 100 thereon spaced just forwardly of the pivot points 94. From their connection points 100 on the member 92, the levers 96 extend rearwardly and downwardly along opposite sides of the wheelchair-seated exerciser 12 (or an able bodied exerciser sitting on the seat portion 34 in its inwardly pivoted position).

To manipulate the force input portion 28 through its exercise motion, the wheelchair-seated exerciser 12 grasps the lever handles 98 and pushes them simultaneously downwardly and forwardly as indicated by the arrow 102, thereby causing an upward pivotal motion of the force input receiving member 92, about its pivot points 94, as indicated by the arrow 104.

Such upward pivotal motion of the force input receiving member 92 is yieldably resisted, with a selectively variable force, by means of a specially designed progressive weight stack assembly 106 which is operatively carried by the resistance portion 30 and is linked to the force input receiving member 92 by means of a conventional chain, sprocket and cam mechanism which is housed within a shrouded upper end section 108 of the resistance portion 30, an exposed outer chain end section 110 being operatively connected at its lower end to the weight stack assembly 106 in a manner subsequently described. Upward pivotal motion of the force input receiving member 92 functions to lift a selectively variable portion of the weight stack assembly 106 during the forward stroke of the levers 96, while hand-resisted opposite pivotal motion of the input portion 28 lowers the lifted portion of the weight stack assembly.

It can be seen that the unique exercise input motion of the machine 10 closely simulates the hand and arm motion of the exerciser 12 which would be used to push on the chair wheels to cause forward ambulation of the wheel chair. By progressively increasing the portion of the weight stack assembly 106 lifted by such lever motion, the muscles used in such wheel chair ambulation may be accordingly developed and further strengthened. While the exercise motion of the machine 10 is particularly well suited to developing and strengthening such wheel chair ambulation muscles, the machine 10 is also useful in strengthening the same muscles in an able bodied exerciser.

Figure 12:
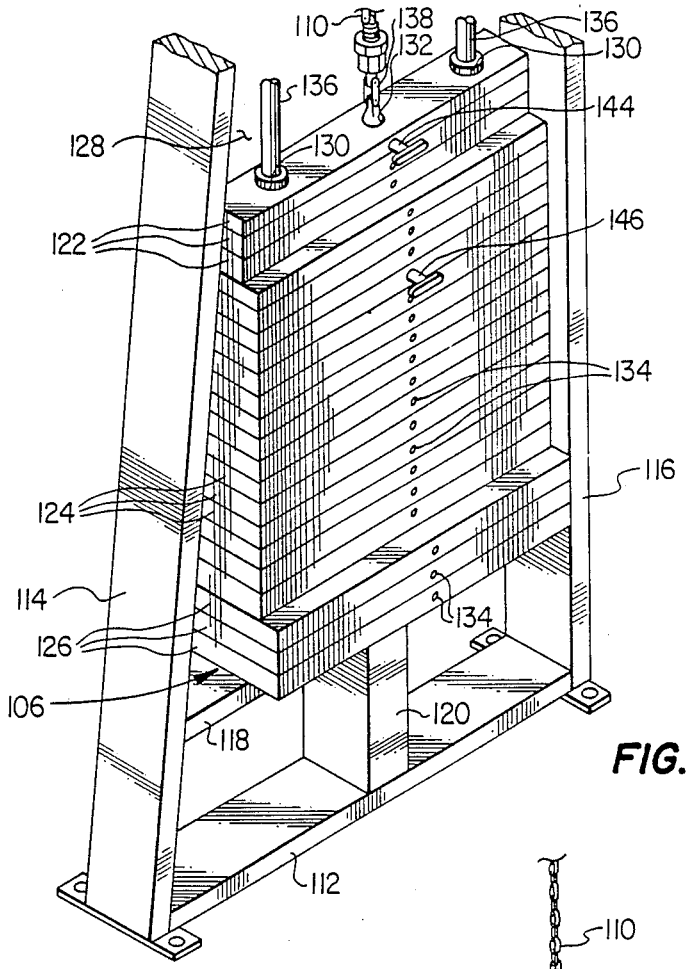
FIGS. 12 and 13 perspectively illustrate the structure and operation of a unique progressive weight stack assembly which may be incorporated into any of the illustrated exercise machines to facilitate the use thereof by physically challenged exercisers.
Figure 13:
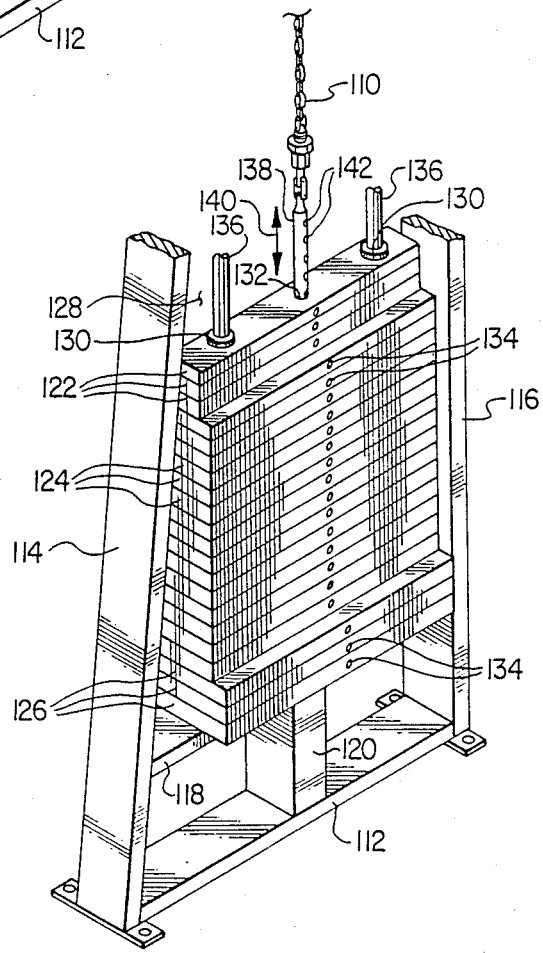

The unique structure and operation of the progressive weight stack assembly 106 will now be described with reference to FIGS. 1, 12 and 13. The resistance portion 30 of the support frame structure 16 of machine 10 includes a horizontal base member 112, a rearwardly sloped front support post member 114, a vertical central support post member 116 positioned rearwardly of the post 114, and an elevated horizontal weight support member 118 intersecured between posts 114, 116 and braced by a short vertical support member 120 intersecured between member 118 and base 12.

The weight stack assembly 106 includes a stack of individual, rectangularly configured weight elements 122, 124 and 126 supported on the horizontal member 118 within an opening 128 bounded by the shroud section 108 and the members 114, 116 and 118. The weight elements 122 are relatively small and define an upper portion of the weight stack, the weight elements 124 are larger and define a vertically intermediate portion of the stack, and the weight elements 126 are still larger and define a lower end portion of the stack.

The individual weight elements 122, 124 and 126 are provided with aligned vertical openings 130 adjacent their front and back ends, aligned vertical openings 132 formed through central portions thereof, and aligned horizontal openings 134, each of which communicates at its inner end with the central vertical opening 132 of the particular weight element. The individual weight elements in the progressive weight stack are held in a predetermined aligned relationship by means of a pair of elongated vertical guide rods 136 which ar slidably extended through the weight element openings 130 and are secured at their opposite ends to the shroud section 108 and the horizontal weight support member 118.

An elongated vertical connection rod member 138 is secured at its upper end to the outer chain end section 110 and is slidably extended downwardly through the aligned central weight element openings 132. The relatively light weight connecting rod 138 is vertically movable, as indicated by the double ended arrow 140 in FIG. 13, relative to the weight stack between upper and lower positions established by the stroke end positions of the input levers 96. The ability to move only the connection rod 138, without moving any of the individual weight elements, provides a very low resistance to the exercise motion of the machine 10 which is particularly beneficial to physically challenged exercisers, particularly those just beginning an exercise program or having only limited hand and arm strength.

The connection rod 138 has formed therein a vertically spaced series of horizontal openings 142 (FIG. 13) which, with the rod lowered, may be aligned with the horizontal weight elements openings 134. A first connecting pin member 144 (FIG. 12) is provided which may be inserted through the horizontal opening 134 in the uppermost weight element 122 and into the uppermost rod opening 142 to thereby secure such weight element to the rod for movement therewith. With the uppermost weight element 122 removably secured to the rod 138 in this manner, when the uppermost weight element rests atop the next adjacent weight element 122, the rest of the rod openings 142 are brought automatically into alignment with the rest of the weight element openings 134.

To connect a selectively variable number of additional weight elements to the rod 138 for movement therewith, a second connecting pin member 146 is provided which may be inserted through another one of the weight element openings 134 into its aligned rod opening 142 to thereby selectively increase the operative weight which resists the pivotal input motion of the machine 10. The progressive sizing of the individual weight elements just described is particularly beneficial to physically challenged exercisers, but also provides a useful weight graduation format for able bodied exercisers.

Figure 2:
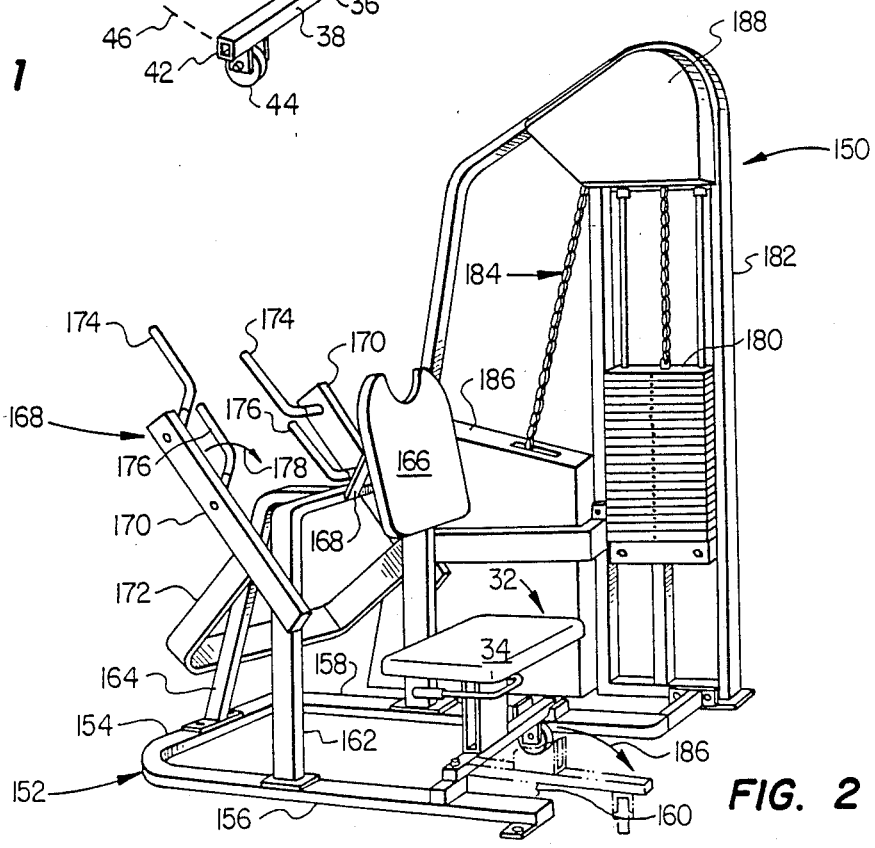
FIGS. 2–6 are perspective views of various alternate embodiments of the exercise machine.

Illustrated in FIG. 2 is an alternate embodiment 150 of the exercise machine 10 which, except for the incorporation therein of the previously described movable seat structure 32, is of a generally conventional structure and operation and provides a "rowing" exercise input motion. The support frame structure of the machine 150 includes a U-shaped base 152 having a closed end portion 154, a pair of opposite leg portions 156 and 158, and an entry area 160 extending inwardly through the open end of the base 152. At generally the inner end of the entry area 160 an inverted U-shaped support member 162 is secured at its lower ends to the base legs 156, 158 and is also secured to the closed end portion 154 of the base 152 by a generally L-shaped bracing member 164. A padded chest engagement member 166 is secured to the upper end of the support member 162 by a sloped support post member 168.

The force input portion 168 of the machine 150 includes a pair of elongated lever members 170 which are pivotally connected at their inner ends to the vertical leg portions of the support member 162 an project leftwardly and upwardly therefrom as illustrated. Central portions of the lever members 170 are interconnected by a U-shaped member 172, and two handle pairs 174 and 176 are secured to the outer ends of the lever members 170 as illustrated.

The movable seat structure 32 is pivotally connected to the base leg 156 as previously described in conjunction with the machine 10, and is illustrated in FIG. 2 in its able bodied user position in which the padded seat portion 34 is positioned within the entry area 160 in an operative location relative to the force input means 168. With the seat structure in this position, the able bodied exerciser sits on the seat 34 facing the force input means 168, places his chest against the member 166, and grasps an appropriate pair of handles 174, 176. The grasped handle pair is then pulled toward the seated exerciser to simulate a rowing motion in which the lever members 170 are pivoted toward the exerciser as indicated by the arrow 178.

The pivotal exercise motion of the levers 170 is yieldably resisted with a selectively variable force by means of a weight stack 180 operatively supported by a resistance frame structure 182 and interconnected with the rightmost lever 170 by means of a conventional chain, sprocket and cam resistance mechanism 184, a portion of which is disposed within shroud sections 186, 188 carried by the frame structure 182.

To rapidly convert the machine 150 for use by a wheelchair-seated exerciser, the seat structure 32 is simply pivoted in a clockwise direction, as indicated by the arrow 186, out of the entry area 160 to thereby permit movement of the wheelchair into such entry area to a position in which the wheelchair seat is disposed generally in the location vacated by the outwardly pivoted machine seat 34. Suitable exerciser body and wheelchair restraining straps (not illustrated in FIG. 2) similar to those illustrated in FIG. 1 may be utilized to safely restrain movement of the exerciser and his wheelchair relative to the machine 150.

It will be appreciated that instead of the movable seat structure 32, the seat structure $32_a$ (FIGS. 7–9) could be alternately connected to the base 152 as previously described in conjunction with the base 18 (FIG. 1) of the exercise machine 10. Additionally, as in the case of the weight stacks of the further machine embodiments subsequently illustrated and described herein, the weight stack 180 may be of the conventional configuration shown in FIG. 2 or similar to the progressive weight stack 106 (FIGS. 12 and 13) of the present invention.

Figure 3:
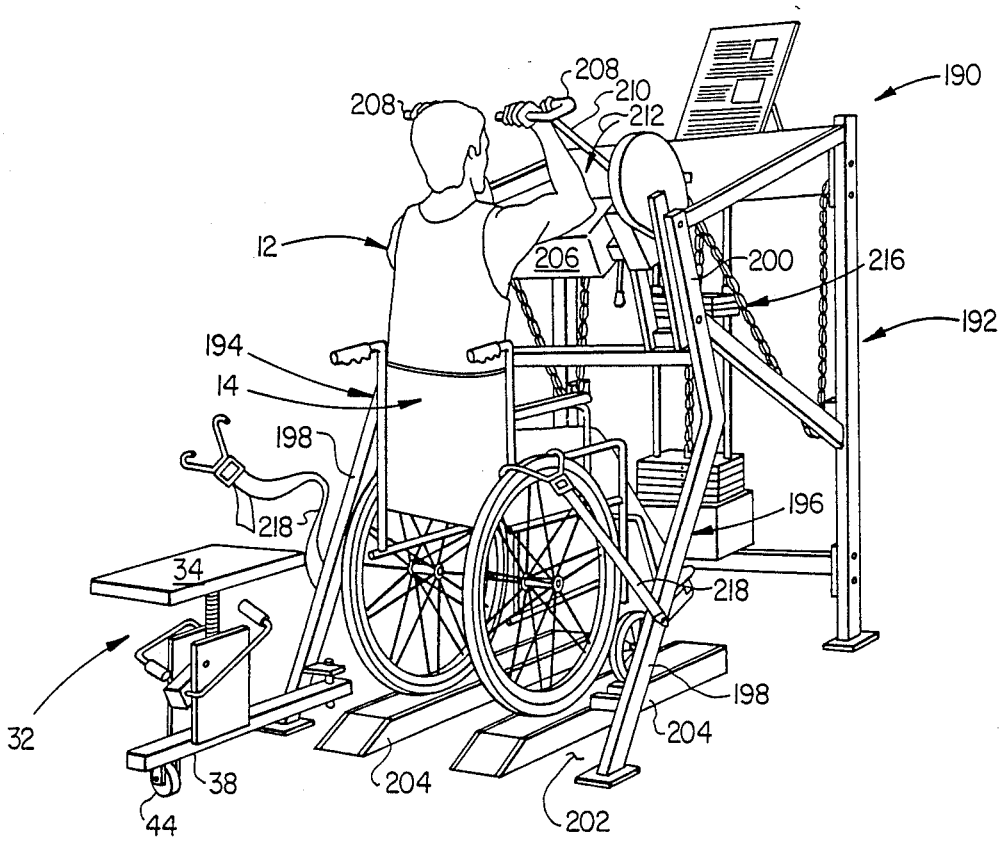

A second alternate embodiment 190 of the exercise machine 10 is depicted in FIG. 3 and is utilized to exercise and strengthen the user's bicep muscles. Except for the incorporation therein of the swing-away seat structure 32, the machine 190 is of a generally conventional structure and operation, and comprises a vertical, floor supported frame structure 192 having a front portion defined by a spaced apart pair of vertical frame members 194 and 196, each of which has a forwardly sloped lower section 198 and a rearwardly sloped upper section 200, the entry area 202 of the machine 190 being generally defined between the lower front frame member sections 198.

The lower support channel portion 38 of the seat structure 32 is pivotally connected at one end thereof to the lower end of the section 198 of the front frame member 194 and is pivotable between its physically challenged user position depicted in FIG. 3, and the able bodied user in which the channel member 38 extends across the very front portion of the entry area 202. With his wheelchair 14 resting upon a suitable pair of height adjusting ramps 204 (selected from the previously mentioned set of ramp pairs) positioned within the unimpeded entry area 202, the wheelchair-seated exerciser 12 positions his elbows atop a padded elbow rest member 206 extending generally horizontally between the upper ends of the frame members 194, 196 and grasps the handle portions 208 of a pair of force input levers 210 which are secured at their inner ends to the frame structure 192 for pivotal motion relative thereto about a horizontal axis disposed forwardly of the exerciser. To exercise his bicep muscles, the exerciser 12 pulls the handles 208 toward his body to thereby pivot the levers 210 in the direction indicated by the arrow 212. Such pivotal motion of the input levers 210 is yieldably resisted with a selectively variable force by means of a weight stack assembly 214 supported on a rear portion of the frame structure 192 and operatively interconnected with the input levers 210 by means of a conventional chain, sprocket and cam mechanism 216. Suitable wheelchair restraining straps 218 are provided which may be hooked onto the chair wheels as previously described.

Figure 4:
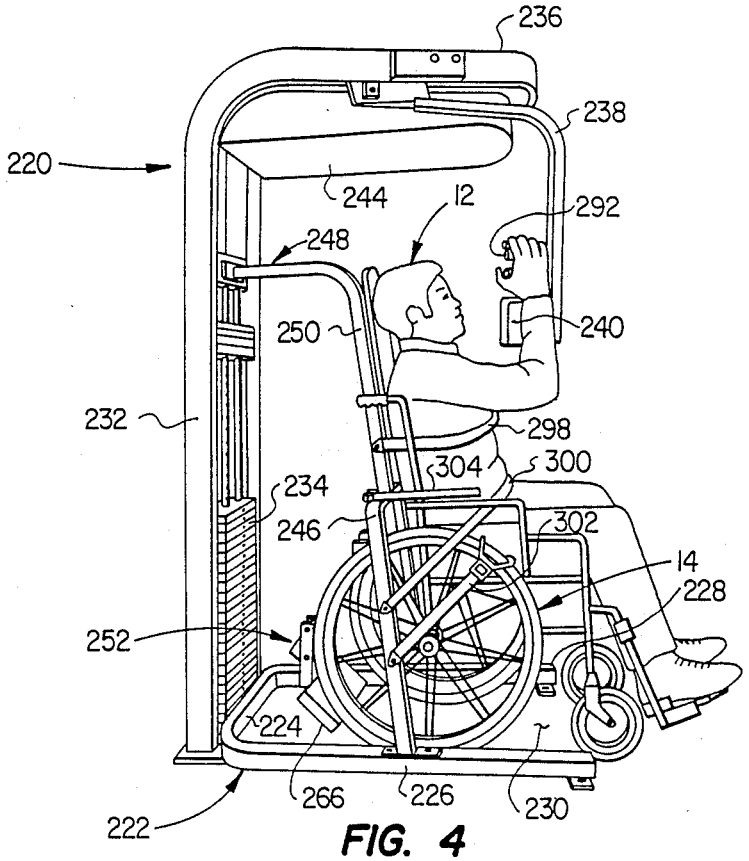

Turning now to FIG. 4, a third alternate embodiment 220 of the exercise machine 10 is utilized to exercise the upper chest muscles of the user. Exercise machine 220, as illustrated, is of a generally conventional construction except for a unique drop-down seat structure subsequently described. The support frame structure of machine 220 includes a U-shaped base 222 having a closed end portion 224 and a pair of leg portions 226 and 228 extending forwardly from the opposite ends thereof, the machine entry area 230 extending inwardly between the ends of such legs. A vertically extending frame portion 232 extends upwardly from the close end 224 of the base 222 and operatively supports a weight stack assembly 234. At its upper end the frame portion 232 has a horizontally extending portion 236 which is positioned over the base 222 and operatively supports a pair of generally L-shaped force input levers 238 (only one of which is visible in FIG. 4), each of which is pivotable about a vertical axis and is provided at its lower end with a padded forearm engagement member 240 and a handle portion 242 positioned directly above the forearm rest portion. A conventional chain, sprocket and cam mechanism is housed within a shroud section 244 carried by the upper horizontal frame portion 236 and is operatively interconnected between the levers 238 and the weight stack 234 to thereby provide a yielding, selectively variable force which resists the pivotal exercise motion of the levers 238.

An inverted U-shaped support member 246 is connected at its lower ends to longitudinally central portions of the base legs 226 and 228, and is sloped toward the vertical frame portion 232 as illustrated. A central upper end portion of the support member 246 is secured to a section of the vertical frame portion 232, above the weight stack 234, by means of a generally L-shaped bracing member 248 having a downwardly extending portion 250 secured at its lower end to the upper end of the support member 246.

To selectively provide for unimpeded movement of the wheelchair 14 into the entry area 230, to position the physically challenged exerciser 12 seated therein in an operative location relative to the force input levers 238, the machine 220 is provided with a specially designed drop-down seat structure 252 which, like the previously described movable seat structure embodiments, is carried by the machine's frame structure for selective movement between able bodied and physically challenged exerciser use positions.

Figure 10:
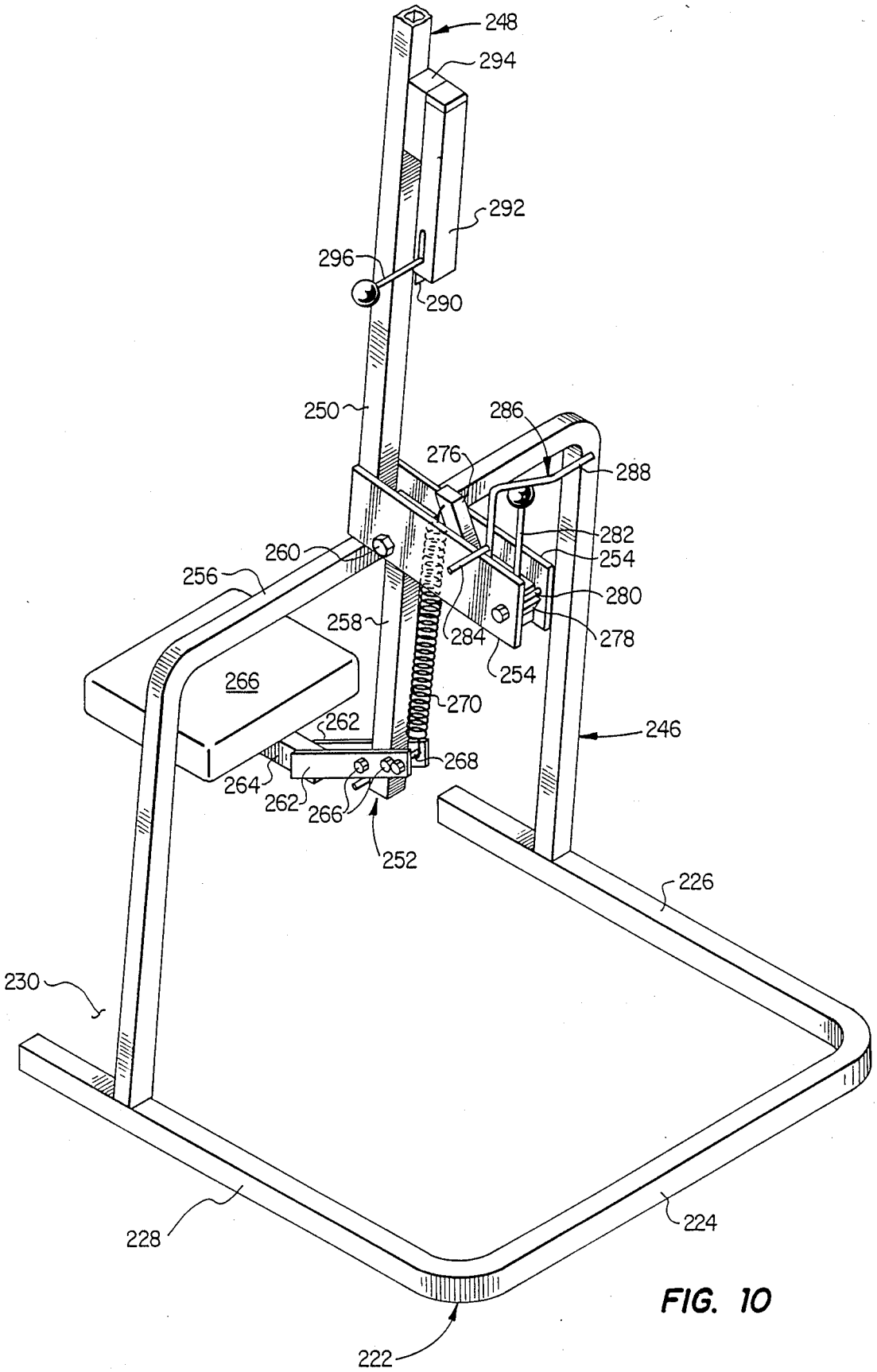
FIGS. 10 and 11 perspectively illustrate the structure and operation of a specially designed drop-down seat mechanism which may be utilized in conjunction with the exercise machines depicted in FIGS. 4–6.
Figure 11:
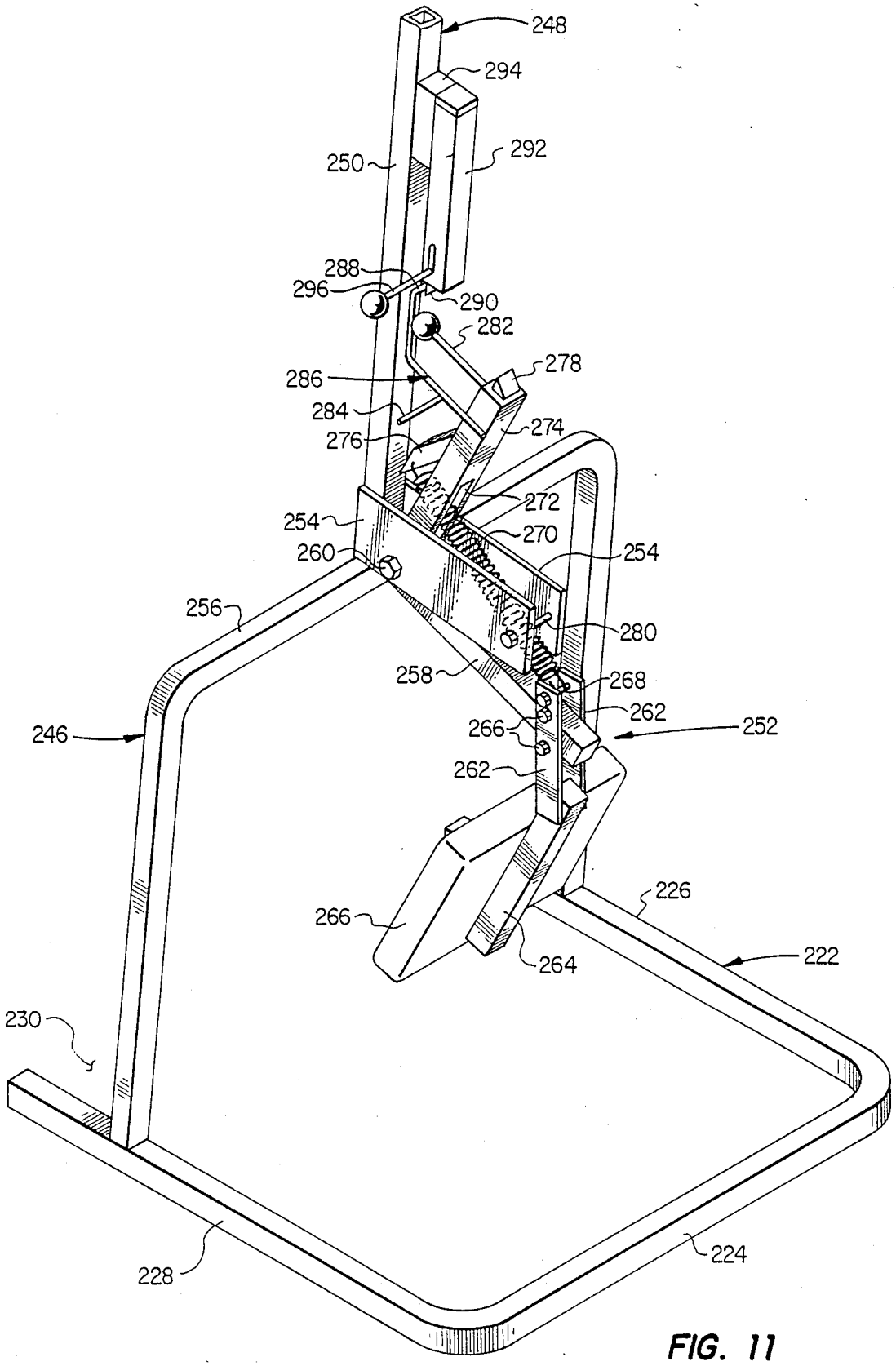

Seat structure 252 is depicted in its able bodied exerciser use position in FIG. 10, and in its physically challenged exerciser use position in FIG. 11, and includes a pair of horizontally extending, elongated rectangular plate members 254 which have inner end portions that straddle a lower end portion of the vertical support frame section 250 and are anchored to the upper end 256 of the inverted U-shaped support member 246. From their connection to the support member 246, the plates 254 extend rightwardly toward the closed end 224 of the base 222. An upper end of an elongated seat carrying member 258 is positioned between the plates 254, adjacent the support frame section 250, and is pivotally secured to the plates 254 by a pivot pin member 260 which extends transversely therethrough.

A pair of elongated rectangular seat support and height adjustment plates 262 straddle the seat carrying member 258 adjacent their inner ends and are anchored at their outer ends to an elongated seat support member 264 to an upper side surface of which a padded seat member 266 is suitably secured. Frictional locking members 266 are extended through plates 262 on opposite sides of the seat carrying member 258 and function in a conventional manner to frictionally lock the plates 262 to the member 258 in a selected longitudinal position therealong to provide for height adjustment of the seat member 266.

A retaining pin 268 is extended through the inner ends of the plates 262 and is secured to one end of an elongated coil spring member 270. From its connection to the pins 268, the spring 270 extends upwardly between the plates 254, through a slot 272 in an elongated rectangular latch housing 274, and is connected at its opposite end to an angled retaining member 276 anchored to a longitudinally central portion of the latch housing 274. An inner end of the latch housing 274 is anchored to the inner end of the seat carrying member 258 for pivotal motion therewith about the pivot pin 260 between a first position (FIG. 10) in which the latch housing 274 is generally parallel to and disposed between the plates 254, and a second position (FIG. 11) in which the latch housing 274 extends upwardly from the plates 254 at a forwardly inclined angle relative thereto. The spring 270 is maintained in a state of tension and functions to maintain the frictional locking members 266 in operative engagement with the seat carrying member 258 to prevent unwanted longitudinal movement of the plates 262 therealong.

The outer end of the latch housing 274 carries a springloaded, generally wedge-shaped latch member 278 which, with the latch housing 274 disposed between the plates 254 as depicted in FIG. 10, is snapped under a locking pin 280 extending between the outer end of plates 254 to prevent counterclockwise pivotal motion of the seat carrying member 258, thereby locking the seat member 266 in its able bodied user position shown in FIG. 10. In such position the seat member projects leftwardly of the support member 246 into the entry area 230 and may be used to seat an able bodied exerciser so that he can grasp the lever handle portions 292 (FIG. 4) and appropriately pivot his bent arms inwardly and outwardly to strengthen and develop his upper chest muscles.

The seat structure 252 may be moved from its locked, able bodied user position depicted in FIG. 10 to its physically challenged user position (FIG. 11) in which the seat structure elements 258, 262, 264 and 266 are pivoted rightwardly of the support member 246, by means of a release lever 282 carried by the outer end of the latch housing 274 and operatively connected to the latch member 278. By pulling the release lever 282 parallel to the latch housing 274 and away from the latch member 278, the latch member is retracted and disengaged from the locking pin 280, thereby permitting the latch housing 274 and the seat carrying member 258 to be pivoted about the pin 260 in a counterclockwise direction to move the seat member 266 from its FIG. 10 position to its FIG. 11 position.

This pivotal motion is facilitated by a handle portion 284 secured to an elongated latch rod member 286 welded at its inner end to the latch housing 274 and having a transversely bent outer end portion 288. With the release lever pulled to retract the latch member 278 from the locking pin 280, the handle 284 is pulled upwardly and toward the support frame section 250 to pivot the member 258 and the latch housing 274 to their positions depicted in FIG. 11, at which point the outer end portion 288 of the latch rod 286 snaps under a spring loaded latch member 290 extending downwardly from the lower end of a latch housing 292 secured to a connecting block member 294 which is in turn anchored to the vertically extending support frame section 250. With the outer latch rod end portion 288 captively retained by the latch member 290 in this manner, clockwise pivotal motion of the latch housing 274 and the seat carrying member 258 is precluded to thereby lock the seat member 266 in its pivotally retracted position depicted in FIG. 11.

To return the seat structure 252 to its able bodied user position, a release lever 296 is carried by the latch housing 292 and operatively connected to the latch member 292 so that when the release lever 296 is pulled upwardly, the latch member 296 is upwardly retracted to release the outer end portion 288 of the latch rod 286 from the latch member 290. The handle portion 284 may then be pushed rightwardly and downwardly to pivot the latch housing 274 downwardly to between the plates 254 and relock the latch member 278 to the locking pin 280 to thereby relock the seat structure 252 in its able bodied user position depicted in FIG. 10.

Returning now to FIG. 4, with the seat structure 252 locked in its physically challenged exerciser use position as just described, the wheelchair 14 may be rearwardly rolled into the entry area 230 to position its seat in the area vacated by the machine's seat member 266. The physically challenged exerciser 12 may then grasp and manipulate the handle portions 292 of the force input levers 238 of the machine 220. The exerciser may be restrained in this operative location by means of an upper body restraining strap 298, a seat belt 300, and a pair of wheel restraining straps 302 which operate in a previously described manner to restrain movement of the wheelchair 14.

In this particular machine embodiment, the exerciser 12 may also use the seat structure 252 in its able bodied user orientation if the exerciser is normally able to slide himself off the wheelchair seat onto another, adjacent seating surface. To facilitate this seat-to-seat transfer, a pair of arm rest assist bars 304 (only one of which is visible in FIG. 4) are pivotally secured to the upper end of the support member 246 and may be pivotally raised or lowered relative thereto as desired. With the wheelchair rolled up to one side of the base 222, and the inner side frame portion of the wheelchair lowered, the exerciser 12 may lower the far side assist bar 304 and use it to help pull himself off of the wheelchair seat and onto the machine seat 266 in its able bodied user position. When his exercise routine is completed, the exerciser 12 may then grasp the far side of the wheel chair seat frame and use it to pull himself off of the machine seat 266 and back onto the wheelchair seat.

Figure 5:
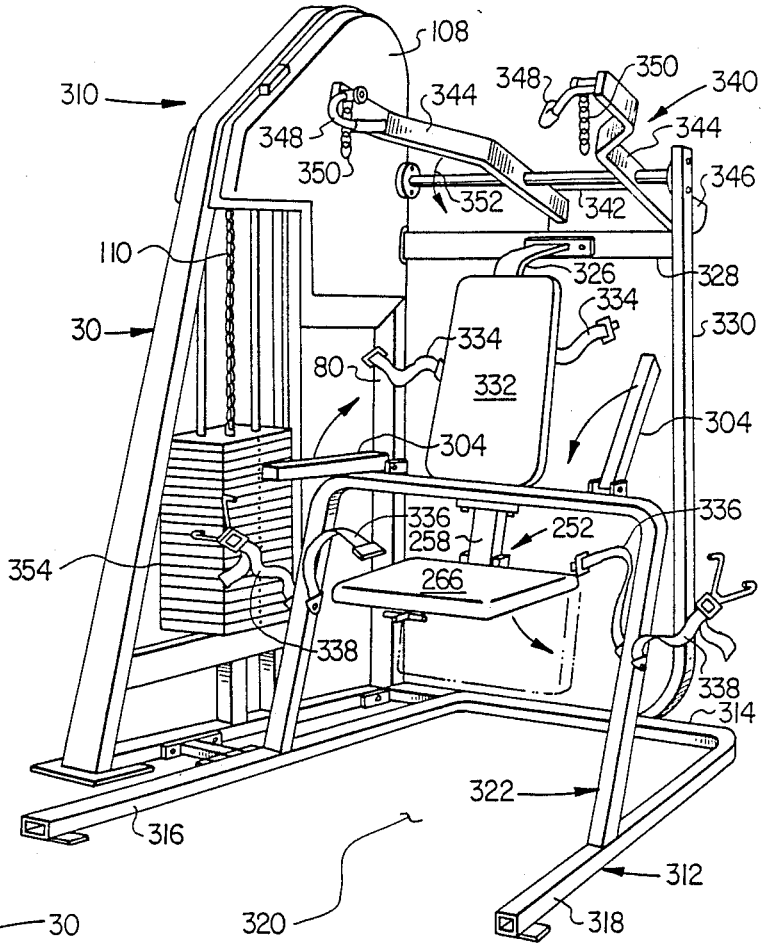

A fourth alternate embodiment 310 of the exercise machine 10 is illustrated in FIG. 5 and is used to provide a "pull down" resisted exercise motion which develops and strengthens the user's arm, shoulder and upper back muscles. Except for the incorporation therein of the previously described drop-down seat structure 252 (shown in simplified form in FIG. 5), and other differences noted below, the machine 310 is of a generally conventional structure and operation. The support frame structure of machine 310 includes a resistance portion 30 similar to that used in machine 10 (FIG. 1), and a U-shaped base 312 having a closed end portion 314, legs 316 and 318, and an entrance area 320. The legs of an inverted U-shaped support member 322, having an upper end 324, are secured at their lower ends to the base legs 316 and 318, the upper end 324 of member 322 having pivotally secured thereto the previously described assist bars 304 to assist a wheelchair exerciser in moving himself from his wheelchair onto the seat portion 266 in its able bodied exerciser use position if desired. The upper end 324 of support member 322 is secured by an L-shaped bracing member 326 to a horizontal frame section 328 anchored at its opposite ends to vertical frame section 80 and a vertical frame member 330 secured at its lower end to the closed end 314 of base 312.

The vertical portion of the bracing member 326 has secured thereto a padded backrest member 332, and the seat carrying member 258 is secured to such vertical portion as previously described in conjunction with the machine 220 in FIG. 4. Also as previously described, the seat structure 252 may be pivoted between an able bodied user position depicted in FIG. 5 and a wheelchair-seated user position similar to that shown in FIG. 4. With seat structure 252 in this latter position the physically challenged exerciser may back his wheelchair into the entry area 320 to position himself and his wheelchair relative to the support member 322 in a manner similar to that shown in FIG. 4. To hold the exerciser and his wheelchair in place, the machine 310 is provided with upper body restraining straps 334, seat belt straps 336 and wheel restraining straps 338.

The force input portion 340 of machine 310 includes a horizontal pivot bar 342 positioned above the horizontal frame member 328 and pivotally connected at its opposite ends to the vertical frame sections 80 and 330. A laterally spaced pair of generally horizontal force input lever members 344 are transversely anchored at longitudinally intermediate portions thereof to the pivot bar 342 and are secured at their inner ends to a suitable counterweight member 346. The outer ends of the levers 344 are positioned generally over the seat member 266 in its able bodied user position, on opposite sides thereof, and are provided with handles 348 to which a pair of depending assist chains 350 are attached.

To use the machine 310 the seated exerciser reaches up and grasps one of the chains 350 and pulls it downwardly, thereby pivoting rod 342 in the direction indicated by arrow 352, to bring the lever handles 348 within his reach. He then grasps the handles 348 and pulls them downwardly to further pivot bar 342 against the resistance force of the selected portion of the weight stack 354 transmitted to rod 342 by the previously described conventional chain, sprocket and cam system housed within the shroud section 108. The exerciser then slowly raises his arms to permit return of the levers 344 to just below their uppermost "at rest" positions shown in FIG. 5. The use of the assist chains 350 assures that when the levers 344 are returned to this position the exerciser's arms are fully extended in an upward direction.

Figure 6:
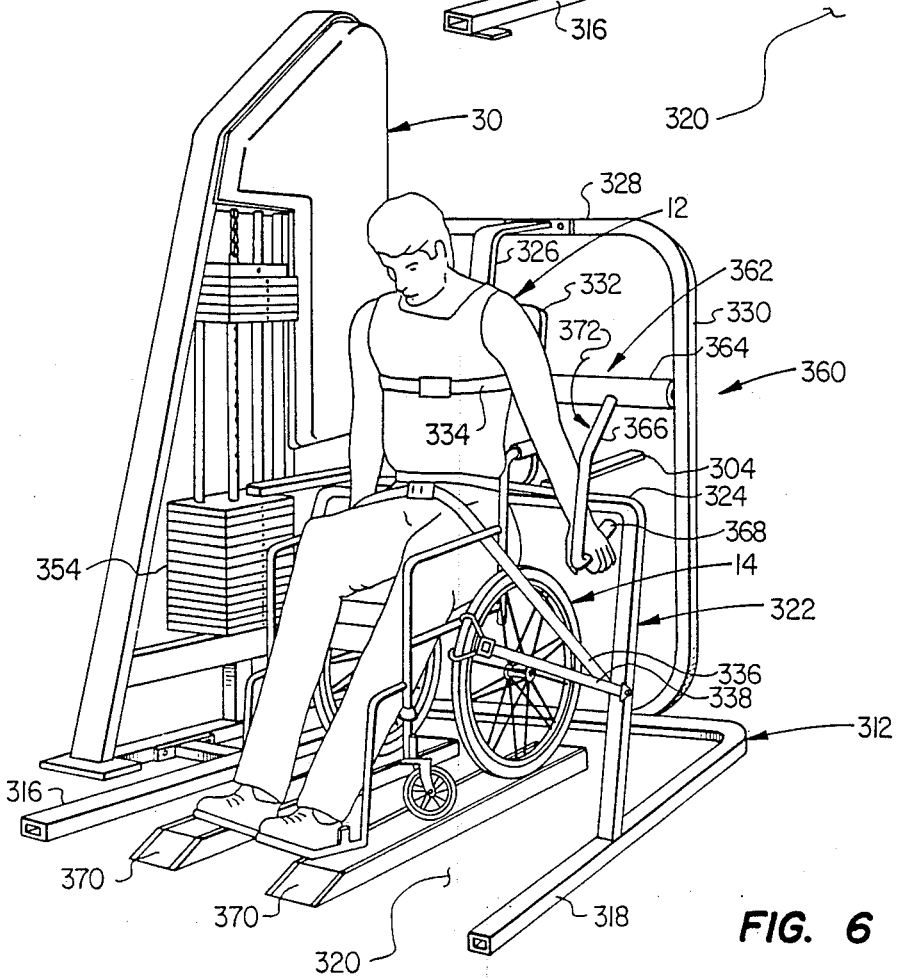

Turning now to FIG. 6, a fifth alternate embodiment 360 of the exercise machine 10 provides a generally conventional "push down" exercise motion which very efficiently exercises, develops and strengthens the seated user's chest, shoulder and tricep muscles. Framewise, the machine 360 is quite similar to that of the machine 340 of FIG. 5, the machine 360 having the previously described U-shaped base 312, the inverted U-shaped support member 322, the resistance structure 30, the vertical frame member 330, the horizontal frame section 328, and the L-shaped bracing member 326 intersecured between frame section 328 and the upper end 324 of support member 322. The movable drop-down seat structure 352 (not visible in FIG. 6) is operatively secured to the frame structure portions 324, 326 as previously described.

The force input portion 362 of the machine 360 includes a horizontal pivot bar 364 positioned below the horizontal frame member 328 and pivotally secured at its opposite ends to the vertical frame member 330 and to the resistance structure 30. A pair of force input levers 366 (only one of which is visible in FIG. 6) are anchored at their inner ends to the pivot bar 364 and project forwardly along opposite sides of the seated exerciser 12. At their outer ends the levers 366 are provided with rearwardly bent handles.

To use the machine 360 in its physically challenged exerciser orientation, with the seat structure 252 in its downwardly pivoted, retracted position, an appropriate pair of height adjustment ramps 370 are operatively positioned within the entry area 320 and the exerciser 12 backs his wheelchair 14 onto the ramps until his back is positioned against the backrest member 332. The exerciser and his wheelchair may then be restrained in place using the previously described straps 334, 336 and 338. Alternatively, the exerciser 12 may use one of the assist bars 304 to slide himself onto the machine seat, in its able bodied user position, as also previously described. When operatively positioned in one of these manners, the exerciser grasps the lever handles 368 and pushes downwardly thereon to pivot the rod 364, in the direction indicated by arrow 372, against the yielding selectively variable resistance force provided as described above by the resistance portion 30 of the machine.

The foregoing detailed description is to be clearly understood as being given by way of illustration and example only, the spirit and scope of the present invention being limited solely by the appended claims.

What is claimed is:

1. An exercise machine conveniently usable by both able bodied and wheelchair-seated exercisers, comprising:

a support frame structure;

force input means carried by said support frame structure, said force input means being hand engageable by an exerciser seated in an operative location relative thereto and forcibly movable by the exerciser relative to said support frame structure through a predetermined exercise motion;

resistance means for resisting said exercise motion of said force input means with a yielding, selectively variable force, said support frame structure having a floor entry area along which a wheelchair may be rolled directly toward said force input means a distance sufficient to position an exerciser seated in the wheelchair in said operative location relative to said force input means; and seat means, including a seat member, carried by said support frame structure for movement relative thereto between first and second positions, said seat means in said first position being disposed within said entry area and operative to position an exerciser sitting on said seat member in said operative location, said seat means in said second position being essentially removed from said entry area to thereby permit a wheelchair - seated exerciser to unimpededly roll the wheelchair along said floor entry area, directly toward said force input means, to a position, adjacent said force input means, in which the wheelchair seat generally occupies the space vacated by said seat member and functions to position the wheelchair - seated exerciser in said operative location.

2. The exercise machine of claim 1 further comprising:

means, carried by said seat means for movement therewith relative to said support frame structure, for selectively adjusting the height of said seat member relative to the balance of said seat means.

3. An exercise machine conveniently usable by both able bodied and wheelchair-seated exercisers, comprising:

a support frame structure;

force input means carried by said support frame structure, said force input means being hand engageable by an exerciser seated in an operative location relative thereto and forcibly movable by the exerciser relative to said support frame structure through a predetermined exercise motion;

resistance means for resisting said exercise motion of said force input means with a yielding, selectively variable force;

seat means, including a seat member, carried by said support frame structure for movement relative thereto between first and second positions, said seat means in said first position positioning an exerciser sitting on said seat member in said operative location, said seat means in said second position permitting a wheelchair - seated exerciser to roll the wheelchair to a position, adjacent said force input means, in which the wheelchair seat generally occupies the space vacated by said seat member and functions to position the wheelchair - seated exerciser in said operative location, said support frame structure defining an entry area of said exercise machine through which an exerciser may move to position himself in said operative location relative to said force input means, and said seat means being secured to said support frame structure for pivotal movement relative thereto between said first and second positions, said seat means in said first position being positioned within said entry area, said seat means in said second position being positioned outwardly of said entry area.

4. The exercise machine of claim 3 further comprising:

means for releasably locking said seat means in said first position.

5. The exercise machine of claim 4 further comprising:

means for releasably locking said seat means in said second position.

6. The exercise machine of claim 3 wherein:

said support frame structure has a floor supportable base portion, and said seat means are rollingly supportable on the floor and are pivotally secured to said base portion for rolling pivotal movement relative thereto between said first and second positions.

7. The exercise machine of claim 3 wherein:

said support frame structure has an elevated portion, and said seat means are carried by said elevated portion for pivotal motion relative thereto, about a horizontal axis, between said first and second positions.

8. The exercise machine of claim 7 further comprising:

assist bar means operatively secured to said elevated portion and usable by a wheelchair-seated exerciser to assist him in moving from his wheelchair seat onto said seat member when said seat means are in said first position.

9. An exercise machine conveniently usable by both able bodied and wheelchair-seated exercisers, comprising:

a support frame structure;

force input means carried by said support frame structure, said force input means being hand engageable by an exerciser seated in an operative location relative thereto and forcibly movable by the exerciser relative to said support frame structure through a predetermined exercise motion;

resistance means for resisting said exercise motion of said force input means with a yielding, selectively variable force;

seat means, including a seat member, carried by said support frame structure for movement relative thereto between first and second positions, said seat means in said first position positioning an exerciser sitting on said seat member in said operative location, said seat means in said second position permitting a wheelchair - seated exerciser to roll the wheelchair to a position, adjacent said force input means, in which the wheelchair seat generally occupies the space vacated by said seat member and functions to position the wheelchair - seated exerciser in said operative location, said support frame structure defining an entry area of said exercise machine into which, with said seat means in said second position, a wheelchair may be rolled to position an exerciser seated therein in said operative location; and means for selectively adjusting the height of a wheelchair positioned in said entry area.

10. The exercise machine of claim 9 wherein:

said means for selectively adjusting the height of a wheelchair include a plurality of differently sized floor ramp pairs each alternatively positionable in said entry area to support the wheels of the wheelchair in an elevated position.

11. An exercise machine conveniently usable by both able bodied and wheelchair-seated exercisers, comprising:

a support frame structure;

force input means carried by said support frame structure, said force input means being hand engageable by an exerciser seated in an operative location relative thereto and forcibly movable by the exerciser relative to said support frame structure through a predetermined exercise motion;

resistance means for resisting said exercise motion of said force input means with a yielding, selectively variable force;

seat means, including a seat member, carried by said support frame structure for movement relative thereto between first and second positions, said seat means in said first position positioning an exerciser sitting on said seat member in said operative location, said seat means in said second position permitting a wheelchair - seated exerciser to roll the wheelchair to a position, adjacent said force input means, in which the wheelchair seat generally occupies the space vacated by said seat member and functions to position the wheelchair - seated exerciser in said operative location; and strap means, connected to said support frame structure, for restraining a wheelchair in said position thereof relative to said support frame structure.

12. The exercise machine of claim 11 wherein:

said strap means include a pair of strap members secured at their inner ends to said support frame structure and having hooked outer end portions operatively securable to the wheels of the wheelchair.

13. An exercise machine conveniently usable by both able bodied and wheelchair-seated exercisers, comprising:

a support frame structure;

force input means carried by said support frame structure, said force input means being hand engageable by an exerciser seated in an operative location relative thereto and forcibly movable by the exerciser relative to said support frame structure through a predetermined exercise motion;

resistance means for resisting said exercise motion of said force input means with a yielding, selectively variable force;

seat means, including a seat member, carried by said support frame structure for movement relative thereto between first and second positions, said seat means in said first position positioning an exerciser sitting on said seat member in said operative location, said seat means in said second position permitting a wheelchair - seated exerciser to roll the wheelchair to a position, adjacent said force input means, in which the wheelchair seat generally occupies the space vacated by said seat member and functions to position the wheelchair - seated exerciser in said operative location; and restraining strap means, secured to said support frame structure, for restraining an exerciser seated in the wheelchair in said position thereof.

14. The exercise machine of claim 1 wherein:

said force input means include a force input member secured to an elevated portion of said support frame structure for pivotal motion relative thereto about a horizontal axis, and a pair of lever members secured to said force input member and extending rearwardly therefrom along opposite sides of a seated exerciser positioned in said operative location and facing said force input member, said lever members having outer end portions, and said exercise motion is effected by grasping said outer end portions and pushing downwardly and forwardly thereon to cause said pivotal motion of said force input member.

15. The exerciser machine of claim 1 wherein:

said force input means include a pair of lever members secured at lower end portions thereof to an elevated portion of said support frame structure for pivotal movement relative thereto about a horizontal axis, said lever members extending rearwardly and upwardly from said elevated portion and having handles operatively secured to outer end portions thereof, and said exercise motion may be effected by a seated exerciser positioned in said operative location, forwardly of and facing said lever members, by grasping and forwardly pulling said handles to rotate said lever members about said horizontal axis.

16. The exercise machine of claim 1 wherein:

said force input means include a horizontal elbow rest member carried by an elevated portion of said support frame structure, and a pair of upwardly projecting lever members positioned rearwardly of said elbow rest member an secured at their lower ends to said support frame structure for pivotal motion relative thereto about a horizontal axis, said lever member having handles operatively secured to their upper ends, and said exercise motion may be effected by a seated exerciser positioned in said operative location, forwardly of and facing said elbow rest member, by placing his elbows atop said elbow rest member, and grasping and forwardly pulling said handles to cause forward pivoting of said lever members.

17. The exercise machine of claim 1 wherein:

said force input means include a depending pair of lever members secured to an elevated portion of said support frame structure, positioned above a seated exerciser in said operative location, for pivotal motion relative thereto about laterally spaced vertical axes extending downwardly along opposite sides of the seated exerciser, said lever members having handles operatively secured to outer end portions thereof, said handles being positioned at opposite sides of the seated exerciser, and said exercise motion may be effected by the seated exerciser by grasping said handles, and then pivoting his arms forwardly to forwardly pivot said lever members to bring them to a position forwardly disposed relative to his upper body.

18. The exercise machine of claim 1 wherein:

said force input means include a horizontal force input member secured to an elevated portion of said support frame structure for pivotal motion relative thereto about a horizontal axis, and a pair of lever members transversely anchored to said force input member and extending forwardly and generally horizontally therefrom above a seated exerciser positioned in said operative location and facing away from said force input member, said lever member having handles secured to forward ends thereof, and said exercise motion may be effected by the seated exerciser by reaching upwardly, and grasping and downwardly pulling said handles to cause pivotal motion of said force input member about said horizontal axis.

19. The exercise machine of claim 18 wherein:

said lever members have an at rest position in which said handles are at least slightly beyond the reach of the seated exerciser, and said exercise machine further comprises a flexible assist member secured to and depending from one of said handles, and reachable by the seated exerciser, whereby the seated exerciser may grasp and downwardly pull the assist member to bring the other of said handles within his reach.

20. The exercise machine of claim 1 wherein:

said force input means include a horizontal force input member secured to an elevated portion of said support frame structure for pivotal motion relative thereto about a horizontal axis, and a pair of lever members transversely anchored at inner ends thereof to said force input member and extending forwardly therefrom along opposite sides of a seated exerciser positioned in said operative location and positioned forwardly of and facing away from said force input member, said lever members having handles operatively secured to forward end portions thereof, and said exercise motion may be effected by the seated exerciser by grasping the handles and forcibly moving them through a downwardly and rearwardly directed arc to pivot said force input member about said horizontal axis.

21. The exercise machine of claim 1 wherein:

said support frame structure has an elevated portion, said force input means are carried by said elevated portion of said support frame structure for pivotal motion relative thereto about a generally horizontal axis, said force input means including hand operable lever means extendable rearwardly along opposite sides of an exerciser seated rearwardly of and facing generally perpendicularly to said axis, said lever means having a handle portion which may be grasped by the hands of the exerciser and pushed, from a position thereof in which said lever means extend generally horizontally, through said exercise motion during said handle portions are simultaneously moved downwardly and forwardly to forcibly pivot said force input means in a first pivotal direction about said axis.

* * * * *